US005439168A

United States Patent [19]

Kim

[11] Patent Number: 5,439,168

[45] Date of Patent: Aug. 8, 1995

[54] PAPER BOX HAVING STRIP-SHAPED INLET

[75] Inventor: Do W. Kim, Seoul, Rep. of Korea

[73] Assignee: Dae Young Packing Co., Ltd., Kyungki-do, Rep. of Korea

[21] Appl. No.: 272,479

[22] Filed: Jul. 11, 1994

[30] Foreign Application Priority Data

Apr. 21, 1994 [KR] Rep. of Korea ..... 94-8398 U
May 31, 1994 [KR] Rep. of Korea ..... 94-12174

[51] Int. Cl.[6] ..... B65D 5/54

[52] U.S. Cl. ..... 229/225; 229/117.22; 229/117.24; 229/206; 229/930

[58] Field of Search ..... 229/117.22, 117.24, 229/206, 224, 225, 930, 931

[56] References Cited

U.S. PATENT DOCUMENTS

| | | | |
|---|---|---|---|
| 2,011,438 | 8/1935 | Daller | 229/225 |
| 2,836,343 | 5/1958 | Will | 229/225 |
| 3,360,112 | 12/1967 | Johnson | 229/117.22 |
| 3,951,333 | 4/1976 | Forbes, Jr. et al. | 229/206 |
| 4,865,203 | 9/1989 | Ueda | 229/206 |
| 4,913,292 | 4/1990 | Field | 229/117.24 |
| 5,031,825 | 7/1991 | Romagnoli | 229/225 |

FOREIGN PATENT DOCUMENTS

| | | | |
|---|---|---|---|
| 2514324 | 4/1983 | France | 229/225 |
| 3140389 | 6/1983 | Germany | 229/225 |
| 2262508 | 6/1993 | United Kingdom | 229/117.22 |

*Primary Examiner*—Gary E. Elkins
*Attorney, Agent, or Firm*—Morgan & Finnegan

[57] ABSTRACT

A paper box for packing detergent which is provided at its inner surface with a strip-shaped inlet so that the inlet closes a tear tape portion to be cut off when the box is opened and which is designed to reduce manufacturing cost, improve productivity and maintain watertightness. The paper box has four vertical wall members, top members extended from upper ends of the vertical wall members, bottom members extended from lower ends of the vertical wall members, a tear tape portion integrally formed at upper portions of three vertical wall members selected from the four vertical wall members, and a strip-shaped inlet attached to inner surfaces of the three vertical wall members such that the tear tape portion is covered with the inlet so as to ensure watertightness against the tear tape portion.

5 Claims, 5 Drawing Sheets

PAPER BOX HAVING STRIP-SHAPED INLET

BACKGROUND OF THE INVENTION

1. Field of the Invention

The present invention relates to a paper box for packing detergent of powder or particles, and more particularly to an improved packing paper box in which a strip-shaped inlet is attached to an inner surface of the box so that the inlet closes a tear tape portion cut off when the box is opened and which is designed to reduce manufacturing cost, improve productivity and maintain watertightness.

2. Description of the Prior Art

Generally, an usual paper box which is adapted to pack solid detergent is integrally formed at its upper portion with a tear tape portion so as to open a lid part easily. Since the tear tape portion is formed at upper portions of vertical wall members of the paper box by a perforated line, outer air and humidity is easily penetrated through the perforated line, thereby causing the solid detergent packed in the box to be agglomerated easily.

Accordingly, the paper box is provided at its inner surface with an inlet such that the inlet covers the tear tape portion in order to improve its durability and prevent penetration of air.

Prevalent methods for providing the inlet include: method of inserting only the inlet, pouring detergent into a paper box and attaching tightly the inlet to a box surface by weight of the detergent contained the box, a method of fixing the inserted inlet to a box surface by rivetting, a method of supplying a cardboard blank adapted to form a box body and an inlet in the same direction to form a sheet of cardboard integrated with the inlet and shaping the integrated cardboard into a box, or a method of preparing a cardboard having four main walls 11, 12, 13 and 14 and three subsidiary walls 15, 16 and 17 and folding the subsidiary walls 15, 16 and 17 inward to define an inlet 20, as shown in FIG. 1.

However, since the inlet 20 formed by the last method is overlapped in its whole surface with an inner surface of a box body 10, the box is unnecessarily increased in its weight and an additional procedure for fixing the inlet 20 is required, thereby lowering productivity.

As shown in FIG. 2, the box body 10 may be also provided at a predetermined position with a hand strap 21 for facilitating its handling during distribution. The above hand strap is usually attached to upper portions of side walls of the box body 10. Both ends of the hand strap 21 are attached to the side walls by means of rivets 25. However, since the detergent contained the box may be early agglomerated by contact with outer air penetrated through rivet holes, the detergent is usually contained in a vinyl envelope and packed in the box 10. Hence, the vinyl envelope is frequently damaged by the protruded rivet portions and thus it is actually difficult to expect high reliance for detergent preservation.

In addition, since the hand strap 21 attached to the box 10, the rivets 25 and the vinyl envelope containing the detergent are made of material bringing about environmental pollution, many people's deep concern are concentrated upon the environmental pollution. Hence, as the protection of environment is emphasized, frequency in use of the material is gradually decreased.

SUMMARY OF THE INVENTION

The present invention has been made in view of the above-described problems occurring in the prior art and an object of the invention is to provide an improved paper box which is enhanced in durability and watertightness.

Another object of the invention is to provide an improved paper box which does not incorporate foreign substance causing environmental pollution but is made of only reproducible paper so that the box can be perfectly reused after use.

In accordance with the present invention, the object mentioned above can be accomplished by providing a paper box having four vertical wall members, top members extended from upper ends of the vertical wall members, bottom members extended from lower ends of the vertical wall members and a tear tape portion integrally formed at upper portions of three vertical wall members selected from the four vertical wall members, said paper box comprising: a strip-shaped inlet attached to inner surfaces of the three vertical wall members such that the tear tape portion is covered with the inlet so as to ensure watertightness against the tear tape portion.

The strip-shaped inlet which is adapted to cover the tear tape portion is attached along its lower end to the inner surface of the paper box.

The lower portion of the inlet adheres closely to the inner paper of the box without distortion due to the cutout portions while the upper portion of the inlet is widened upward at a predetermined inclination, whereby it is possible to reduce maximally introduction of outer air and to lock firmly the lid part when the lid part is closed.

BRIEF DESCRIPTION OF THE DRAWINGS

These and other objects, features and advantages of the invention will become more apparent upon a reading of the following detailed specification and drawings, in which.

DETAILED DESCRIPTION OF THE PREFERRED EMBODIMENTS

An embodiment according to a paper pack according to the present invention will be described with reference to the accompanying drawings hereinafter.

Figure 1:
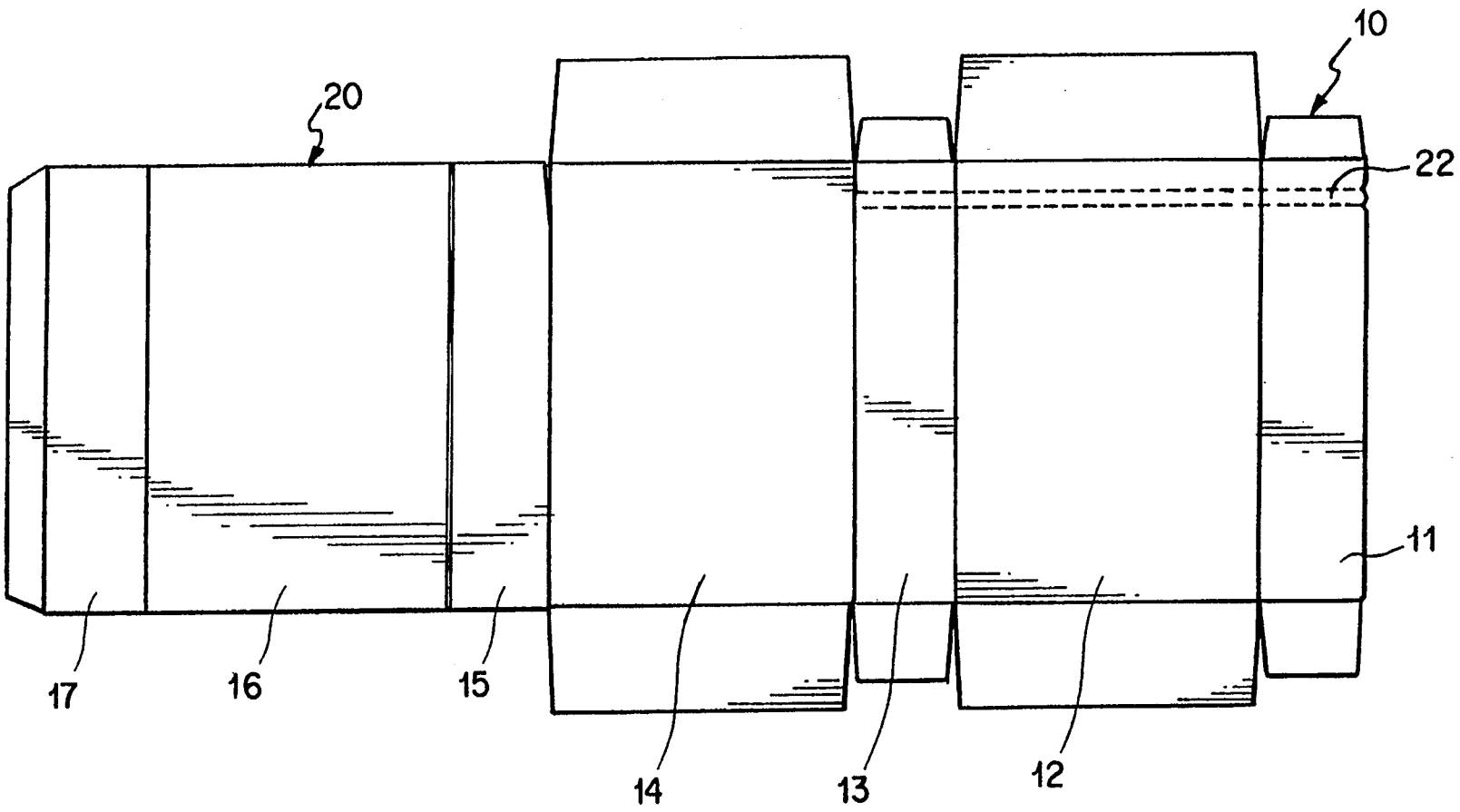
FIG. 1 PRIOR ART
FIG. 1 is a development view of a conventional paper box.
Figure 2:
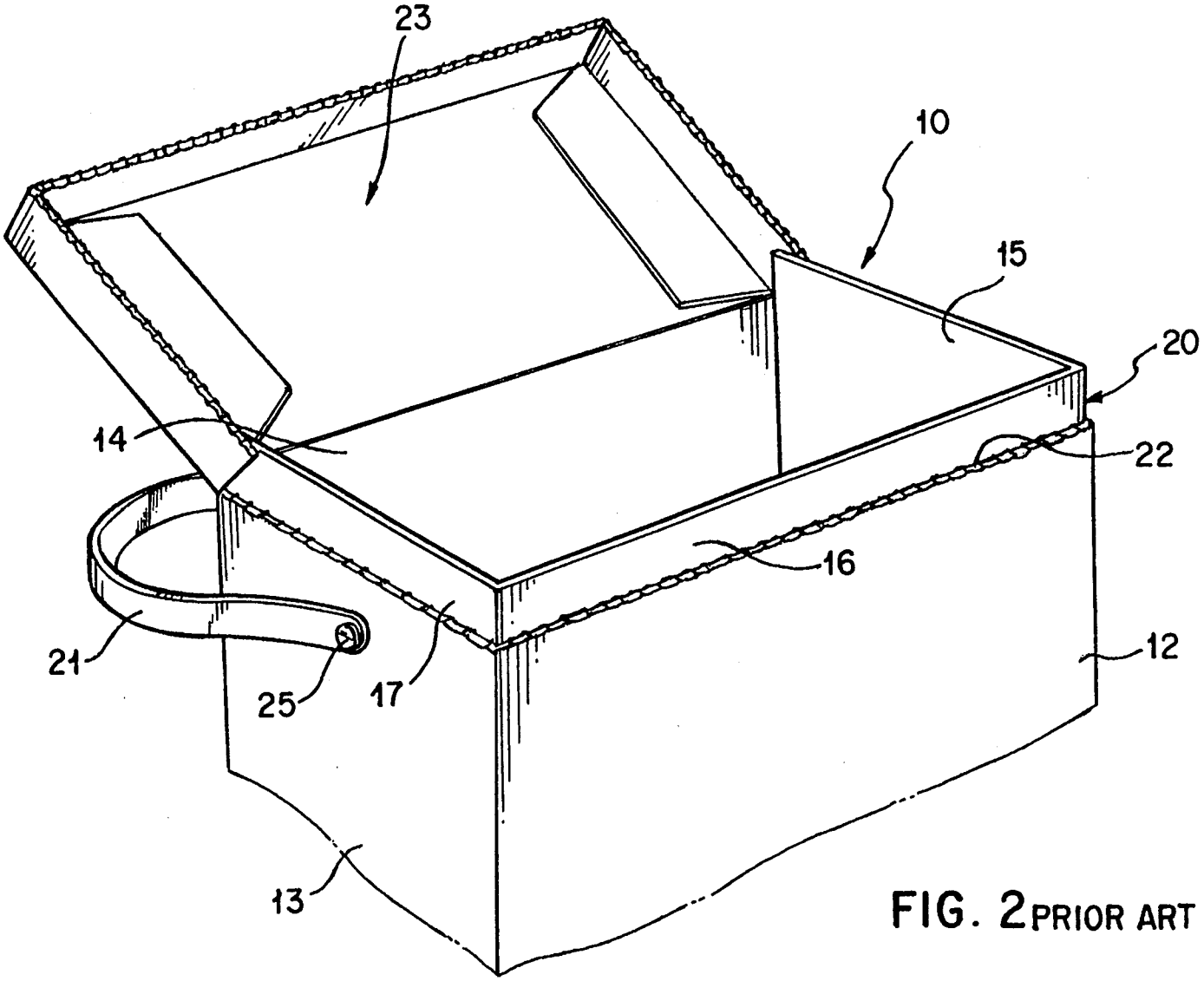
FIG. 2 PRIOR ART
FIG. 2 is a perspective view showing an using state of the paper box of FIG. 1.
Figure 3:
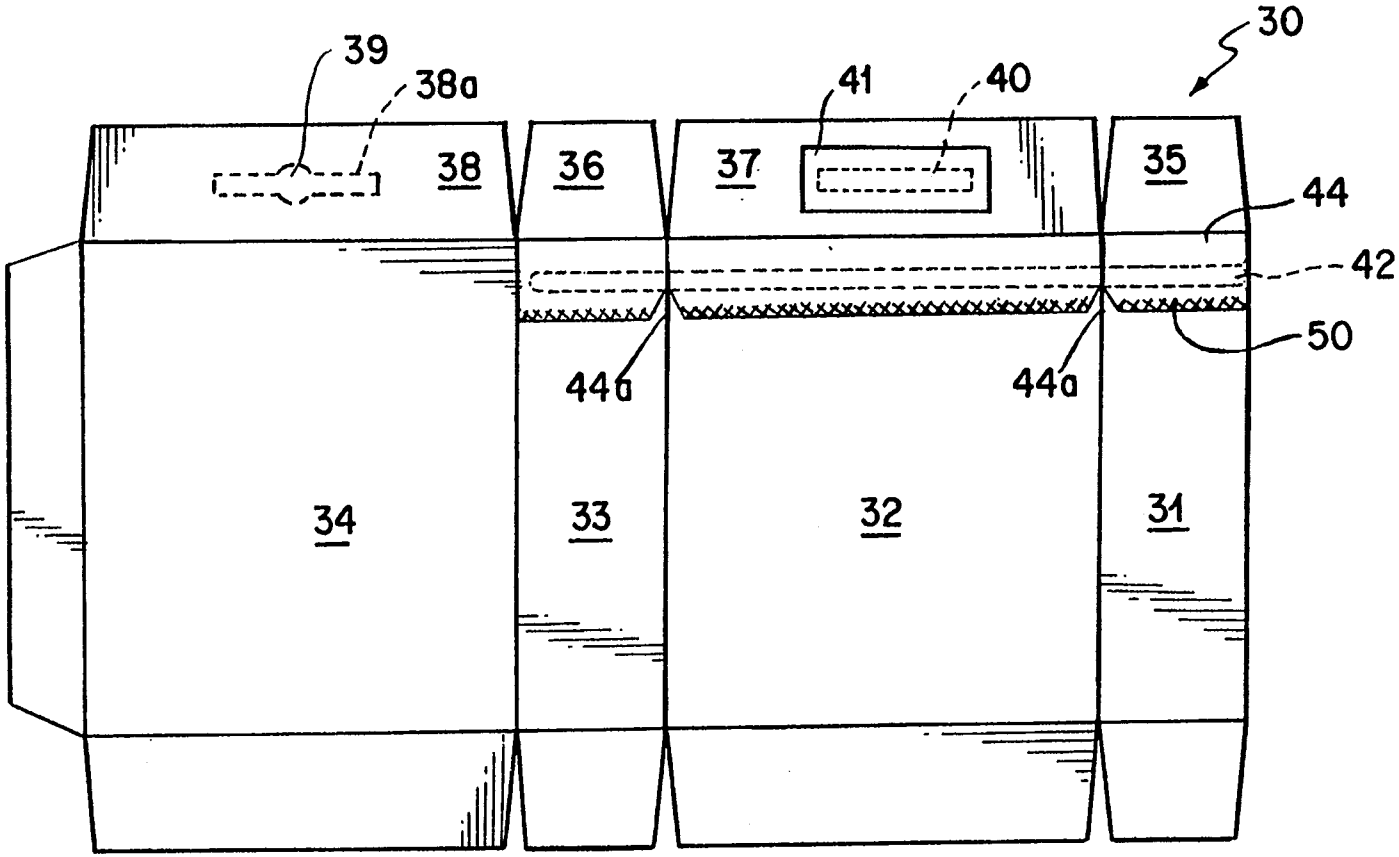
FIG. 3 is a development view of a paper box according to the present invention.
Figure 4:
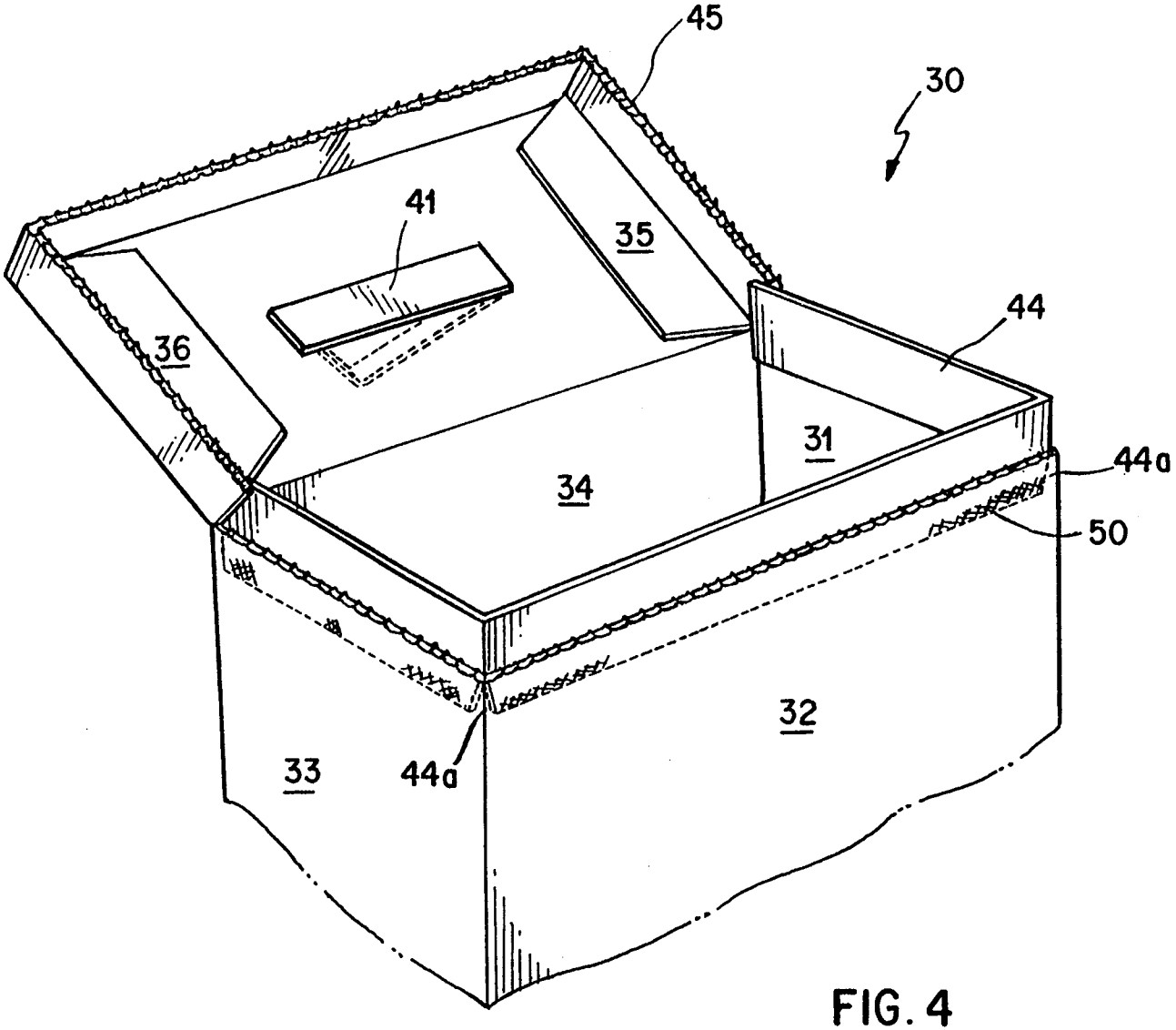
FIG. 4 is a perspective view of the paper box of FIG. 3 wherein top members are developed.

FIG. 3 is a development view of a paper box according to the invention and FIG. 4 is a perspective view showing using state of the paper box of FIG. 3 which is opened in its upper part.

As illustrated in the drawings, the paper box of the invention comprises four vertical wall members 31, 32, 33 and 34, a pair of flap members 35 and 36 extended from upper ends of the vertical wall members 31 and 33 and inner and outer lid members 37 and 38 extended from upper ends of the vertical wall members 32 and 34 and adapted to be disposed onto the flap members 35 and 36, in similar to an usual paper box.

The flap members 35 and 36 extended from the side vertical wall members 31 and 33 have certain widths such that the flap members 35 and 36 are attached to the inner lid member 37. The inner lid member 37 is provided at its middle portion with an internal strap 40 attached thereto. The paper strap 40 to be concealed is integrally formed with a strap fixing plate 41. More specifically stated, the inner lid member 37 is formed at its middle portion with a rectangular cutout portion and the strap fixing plate 41 is attached to an inner surface of the inner lid member 37 such that the strap fixing plate 41 closes the cutout portion. Accordingly, the strap 40 can be spread upward if desired. The paper strap 40 is covered up by the outer lid member 38.

The outer lid member 38 extended from the rear vertical wall member 34 is integrally formed at its middle portion with a strap cover 39 and the strap cover 39 is defined by a perforated line 38*a*. When the paper strap 40 is necessary to be used, the strap cover 39 is cut off to expose the paper strap 40 to outside.

The three predetermined vertical wall members 31, 32 and 33 selected from the four vertical wall members 31, 32, 33 and 34 are formed at upper portions thereof with a tear tape portion 42. The three vertical wall members 31, 32 and 33 are provided at inner surfaces of upper ends with a strip-shaped inlet 44 having an enough size to cover the tear tape portion 42 in order to prevent outer air from being penetrated into the box.

The inlet 44 attached to the tear tape portion 42 is made of Manila paper so as to block efficiently introduction of outer air. The inlet 44 is applied along its lower end with adhesive to maintain efficient adhesive force and watertightness between the inner surface of the box and the inlet.

Figure 6:
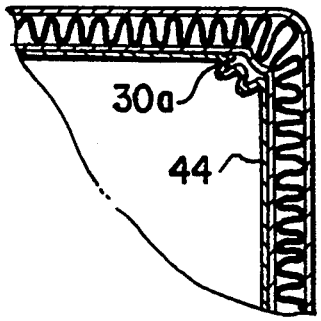
FIG. 6 is a horizontal sectional view showing an inlet separated from a corner of the box.
Figure 7A:
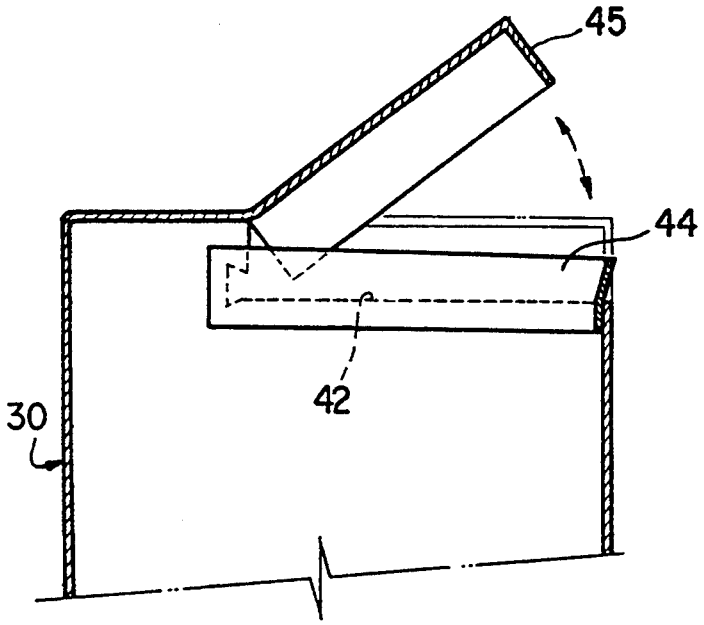
FIG. 7A is a vertical sectional view of the paper box of the invention in which a lid part is opened.
Figure 7B:
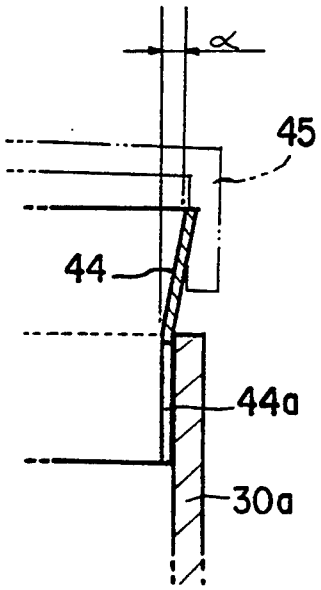
FIG. 7B is an enlarged sectional view of the inlet of FIG. 7A.

In accordance with the invention, the lower portion of the inlet 44 to which the adhesive 50 is applied may be formed at bent locations with predetermined cutout portions 44*a* by using die cutting. In case of the inlet without the cutout portions, when the cardboard forming the box body is bent, corner portions of an inner paper of the cardboard is distorted and protruded inward. However, when the cardboard and the inlet are bent, the cutout portions of the invention can prevent the inlet from being separated from the main corrugated paper 30*a*, as shown in FIG. 6.

Figure 5A:
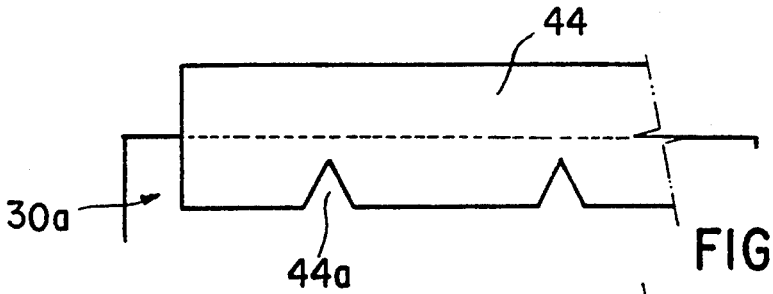
FIG. 5 is an enlarged development view of an inlet of the invention.
Figure 5B:
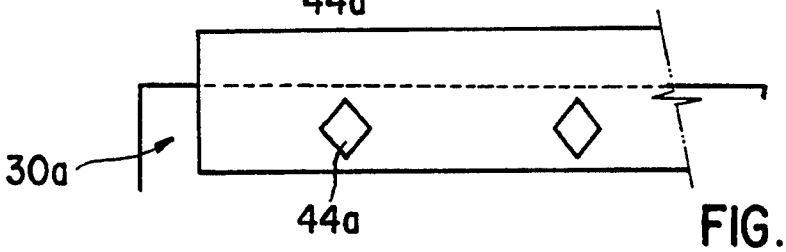

The cutout portion 44*a* of the inlet 44 may be formed into a notch-shaped portion opening downward as shown in FIG. 5A, but the cutout portion 44a may be also formed into a diamond-shaped portion enclosed by the inlet in view of shaping and assembling process of the cardboard as shown in FIG. 5B.

Assembling process of the above-constructed detergent packing paper box will now be described. As again shown in FIG. 3, the three vertical wall members 31, 32 and 33 are formed at upper portions thereof with the tear tape portion 42. Thereafter, the strip-shaped inlet 44 is attached to the inner surface of three vertical wall members under the tear tape portion 42 by adhesive such that the tear tape portion 42 is efficiently covered with the inlet 44. Bottom flap members and a side flap member are attached by adhesive such that a detergent receiving space is defined by the vertical and the bottom members, similarly to the usual assembling process.

In this case, since the upper end of the box body 30 is attached with the strip-shaped inlet 44 and the lower portion of the inlet 44 is formed with the cutout portions 44*a*, the lower portion of the inlet 44 is not distorted and adheres closely to the inner paper 30*a* of the cardboard.

The lower portion of the inlet 44 can be bent without distortion because of the lessened length by the cutout portions while the upper portion of the inlet 44 can press strongly the portion above the tear tape portion, that is, the upper portion of the inlet 44 functions as locking means.

Subsequently, the detergent receiving space of the box is filled with a predetermined amount of powder detergent and then the flap members 35 and 36 extended from the side vertical wall members 31 and 33 are folded inward. The flap members 35 and 36 are applied at outer surfaces thereof with a predetermined width of adhesive and then the inner lid member 37 having the paper strap 40 and the outer lid member 38 having the strap cover 39 are folded inward and attached to the adhesive applied to the outer surface of the flap members 35 and 36, thereby providing a desired paper box.

Since the paper box 30 assembled in this manner maintains efficient impact resistance and watertightness, it is possible to prevent agglomeration of detergent occurring during transportation and distribution of the product.

In use of the above-constructed paper box, the user pierces an end of the tear tape portion 42 with his finger and pulls the end of the tear tape portion 42 to cut off the tear tape. The upper part of the paper box formed by cutting off the tear tape is turned over upward, thereby providing a half lid part 45 corresponding to the length of the tear tape 42.

Positioned at the inner surface of the upper portion of the box 30 which has been cut by removing the tear tape is the inlet 44 covering the tear tape opening. At this time, as described previously, the lower portion of the inlet 44 adheres closely to the inner paper 30*a* of the box 30 without distortion due to the cutout portions 44*a*, while the upper portion of the inlet 44 is widened upward at a predetermined inclination. Accordingly, it is possible to reduce maximally introduction of outer air and to prevent the half lid part 45 from being incidentally opened when the half lid part 45 of the box body 30 is opened and closed or the paper box 30 is kept with the closed half lid part.

The position and the size of the lid part 45 formed by the tear tape 42 may be appropriately changed according to the size of the paper box and its application and there is also no reason that the position of the paper strap 40 protruded from the outer lid member 38 is limited.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A paper box comprising:

four vertical wall members, top members extended from upper ends of the vertical wall members, bottom members extended from lower ends of the vertical wall members, all said members having an inner surface:

a tear tape portion integrally formed at upper portions of three vertical wall members selected from the four vertical wall members, said tear tape portion having a tear tape;

a lid part, separable from the three selected vertical wall members by operation of the tear tape; and a strip shaped inlet having a lower end, said strip shaped inlet attached to the inner surfaces of the three selected vertical wall members such that the tear tape portion is covered with the inlet so as to ensure watertightness against the tear tape portion, the tear tape portion attached along the lower end to the inner surfaces of the three selected vertical members of the paper box.

2. A paper box according to claim 1, wherein the strip shaped inlet having an upper portion and a lower portion is formed at bending portions of said lower portion with predetermined corner cutout portions by die cutting to prevent the lower portion of the inlet from being separated from the inner surfaces of the three selected vertical members of the paper box.

3. A paper box according to claim 2, wherein the lower portion of the inlet adheres closely to the inner surface of the box without distortion due to cutout portion while the upper portion of the inlet is widened upward at a predetermined inclination, said inclination predetermined to minimize introduction of outer air and to lock firmly the lid part when the lid part is closed.

4. A paper box according to claim 2, wherein the cutout portion formed at the lower portion of the inlet is formed shaped as a notch-shaped portion opening downward.

5. A paper box according to claim 2, wherein cutting out the cutout portion formed at the lower portion of the inlet forms a hole enclosed by the inlet.

* * * * *